US009470416B2

(12) United States Patent
Ruottu

(10) Patent No.: US 9,470,416 B2
(45) Date of Patent: Oct. 18, 2016

(54) METHOD TO ENHANCE OPERATION OF CIRCULATING MASS REACTOR AND METHOD TO CARRY OUT SUCH REACTOR

(75) Inventor: Seppo Ruottu, Kotka (FI)

(73) Assignee: Endev Oy, Kotka (FI)

( * ) Notice: Subject to any disclaimer, the term of this patent is extended or adjusted under 35 U.S.C. 154(b) by 638 days.

(21) Appl. No.: 13/981,146

(22) PCT Filed: Jan. 23, 2012

(86) PCT No.: PCT/FI2012/050057

§ 371 (c)(1),
(2), (4) Date: Aug. 19, 2013

(87) PCT Pub. No.: WO2012/101324

PCT Pub. Date: Aug. 2, 2012

(65) Prior Publication Data

US 2013/0323654 A1 Dec. 5, 2013

(30) Foreign Application Priority Data

Jan. 24, 2011 (FI) ..... 20110017

(51) Int. Cl.
*F23C 10/04* (2006.01)
*F22B 31/00* (2006.01)
(Continued)

(52) U.S. Cl.
CPC ..... *F23C 10/04* (2013.01); *F22B 31/0084* (2013.01); *F23C 10/08* (2013.01); *F23C 10/10* (2013.01); *F23C 10/28* (2013.01); *F23J 2900/15026* (2013.01)

(58) Field of Classification Search
CPC .... F22B 31/0084; F23C 10/10; F23C 10/04; F23C 10/08; F23C 10/28; F23J 2900/15026
See application file for complete search history.

(56) References Cited

U.S. PATENT DOCUMENTS 4,552,203 A 11/1985 Chrysostome et al.
4,672,918 A 6/1987 Engstrom et al.
(Continued)

FOREIGN PATENT DOCUMENTS

FI 20031540 A 4/2005
JP 60-044711 A 3/1985
(Continued)

OTHER PUBLICATIONS

Japanese Office Action for corresponding Japanese Patent Application No. 2013-550921 mailed Dec. 24, 2015 (English translation).
(Continued)

*Primary Examiner* — Alfred Basichas
(74) *Attorney, Agent, or Firm* — Merchant & Gould P.C.

(57) ABSTRACT

The object of the invention is a method for enhancing the operation of a circulating mass reactor (1), which circulating mass reactor (1) comprises a fluidized-bed chamber (8) provided with a fluidized bed (108), means for separating fluidized material (80) from the flue gases, and a return conduit system (15, 16, 19) including at least one cooled return conduit (15, 16). In the method, for the combustion of fuel taking place in the circulation mass reactor (1) is provided a lower combustion chamber (89), which comprises a fluidized-bed chamber (8), and an upper combustion chamber (11) and a flow conduit (10) connecting them. The flow conduit (10), the means for separating the fluidized material (80) from the fuel gases and the return conduit system (15, 16, 19) are arranged to be located essentially between the lower combustion chamber (89) and the upper combustion chamber (11). The lower combustion chamber (89) and the upper combustion chamber (11) are dimensioned in such a way that the combustion of the fuel can be essentially completed before the discharge of the flue gases from the combustion chamber (11), whereupon the average delay time of the flue gases in the upper combustion chamber is most preferably 0.3-3.0 seconds. The fluidized material (80) is separated from the flue gases after the upper combustion chamber (11) and guided back to the fluidized-bed chamber (8) through cooled return conduits (15, 16) and an uncooled return conduit system (19) in the desired ratio.

32 Claims, 1 Drawing Sheet

Figure 1:
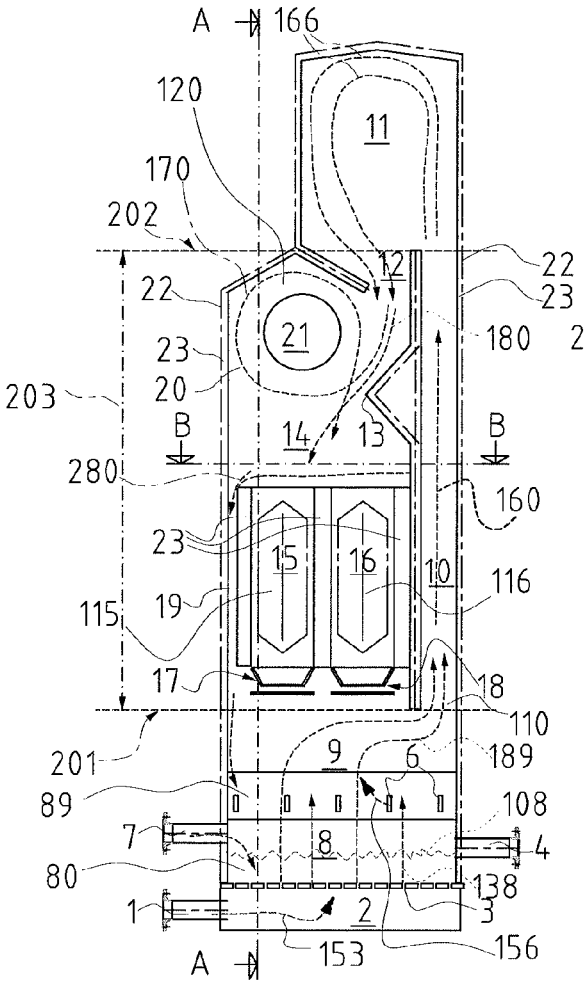

(51) Int. Cl.

| | |
|---|---|
| ***F23C 10/10*** | (2006.01) |
| ***F23C 10/08*** | (2006.01) |
| ***F23C 10/28*** | (2006.01) |

(56) References Cited

U.S. PATENT DOCUMENTS

| | | | | |
|---|---|---|---|---|
| 4,755,134 | A * | 7/1988 | Engstrom | B01J 8/005 110/245 |
| 4,899,695 | A * | 2/1990 | Brian | F22B 31/003 110/346 |
| 4,934,281 | A | 6/1990 | Engström et al. | |
| 5,257,585 | A | 11/1993 | Sato et al. | |
| 5,341,766 | A * | 8/1994 | Hyppanen | B01J 8/1836 110/245 |
| 5,601,039 | A * | 2/1997 | Hyppanen | F22B 31/0084 110/216 |

FOREIGN PATENT DOCUMENTS

| | | | |
|---|---|---|---|
| JP | 61-049913 | A | 3/1986 |
| JP | S61-240010 | A | 10/1986 |
| JP | 4-198604 | A | 7/1992 |
| JP | H04-198604 | A | 7/1992 |
| JP | H05-126326 | A | 5/1993 |
| JP | H11-504261 | A | 4/1999 |
| JP | 2001-221405 | A | 8/2001 |
| JP | 2006-194533 | A | 7/2006 |
| WO | WO 2005/037422 | A1 | 4/2005 |
| WO | WO 2009/022060 | A1 | 2/2009 |

OTHER PUBLICATIONS

International Search Report for corresponding International Patent Application No. PCT/FI2012/050057 mailed May 21, 2012.

International Preliminary Report on Patentability for corresponding International Patent Application No. PCT/FI2012/050057 mailed Feb. 6, 2013.

Finnish Search Report for corresponding Finnish Patent Application No. 20110017 mailed Nov. 7, 2011.

* cited by examiner

METHOD TO ENHANCE OPERATION OF CIRCULATING MASS REACTOR AND METHOD TO CARRY OUT SUCH REACTOR

This application is a National Stage Application of PCT/FI2012/050057, filed 23 Jan. 2012, which claims benefit of Serial No. 20110017, filed 24 Jan. 2011 in Finland and which applications are incorporated herein by reference. To the extent appropriate, a claim of priority is made to each of the above disclosed applications.

OBJECT OF THE INVENTION

The invention relates to a method for enhancing the operation of a circulating mass reactor, in which circulating mass reactor, at least a part of the heat contained by the flue gases formed in the circulating mass reactor is transferred to the fluidized material arranged to circulate in the circulating mass reactor, and which circulating mass reactor comprises a fluidized-bed chamber, in the lower part of which is provided a fluidized bed containing fluidized material, means for separating fluidized material from the flue gases, and a return conduit system, through which the fluidized material can be returned to the fluidized-bed chamber and which includes at least one cooled return conduit, in which a part of the heat energy contained by the fluidized material passing therethrough is transferred to the heat transfer liquid circulating in the circulating mass reactor by means of heat exchangers fitted in the return conduits. The invention also relates to a circulating mass reactor for carrying out the method.

PRIOR ART

The stabilising and balancing effect of solid particles on the temperature of flue gases in combustion technology has been widely utilised in fluidized-bed reactors already for decades. In reactors with fluidized layers, also referred to as fluidized-bed reactors, combustion air is supplied from the lower part of the furnace through a sand bed formed on the bottom of the combustion chamber. The fuel supplied to the furnace mixes with the help of the combustion air with the sand bed acting in an bubbling manner, where it dries and ignites. The continuous mixing of the fuel with the sand of the fluidized bed, combustion air and ash enhances the mixing and transfer of heat and gases. Moreover, the sand material in the fluidized bed binds heat, thus balancing temperatures during the combustion process and at the same time enhances the igniting of the fuel.

Reactors with fluidized layers refer to both fluidized-bed and circulating fluidized-bed reactors. The concept of a reactor, on the other hand, covers both the plain reactors, in which actual heat transfer to the heat carrier is not carried out in themselves, and steam boilers, the heat generated in which is transferred in conjunction with the boiler to the water or corresponding heat transfer liquid circulating in the boiler. In the following, the term "boiler" is not, however, necessarily intended to limit each subject matter at hand to concern merely steam boiler solutions.

Especially in circulating fluidized-bed reactors, the aim is to adjust the gas flow velocity in the lower part of the essentially vertical reaction chamber between the minimum gas flow velocity for fluidizing the fluidized material and the gas flow velocity for conveying. Typically, the aim is for the solids in powder form, which are in a fluidized state, that is, the fluidized material, to have a volume fraction of 10-40%. It is characteristic of the fluidized state of the fluidized material that the instantaneous velocity of the fluidized material varies between below and above zero due to the variation of the instantaneous velocity of the gas both in time and position on both sides of the time average. As a result, fluidized material is also conveyed above the actual fluidized bed.

Above the fluidized bed is generally used a gas velocity greater than the critical velocity of the pneumatic conveyance of fluidized material. In that case, fluidized material discharges with the gas flow from the combustion chamber. If the volume fraction of the fluidized material within the pneumatic conveyance area of the combustion chamber is small, in which case also the flow of fluidized material discharging from the combustion chamber is low, the reactor is called an bubbling fluidized-bed reactor. The term generally used is a fluidized-bed boiler (FBB), when the sand of the fluidized bed remains mainly in the bed itself and in the gas space immediately above it.

In a circulating fluidized-bed boiler (CFB), that is, a circulating mass reactor, the gas velocity is instead dimensioned in such a way that a significant part of the sand chips acting as heat carrier particles is swept upwards from the fluidized bed with the gas flow and discharges from the reaction chamber. The material flow is returned to the reaction chamber by means of a cyclone or other returning apparatus.

PROBLEMS RELATING TO THE PRIOR ART

Whenever fluidized material is fluidized or conveyed in a rising gas flow, a vertical pressure gradient is formed in the gas flow in such a way that the pressure decreases in the vertical direction. The absolute value of the pressure gradient in the gas flow is directly proportional to the volume fraction of the fluidized material.

In the horizontal direction, on the other hand, the pressure gradient is essentially zero. When no horizontal velocity-maintaining pressure difference is formed in the gas in the said state of flow, the horizontal velocity component of the gas supplied from feed openings in the wall of the reactor chamber decreases rapidly due to the effect of friction between the fluidized material and the gas. The initially horizontal gas flow thus becomes vertical. Because of this, in fluidized-bed reactors, combustion air supplied from the walls mixes poorly with the low-oxygen vertical main flow.

Since, at the same time, the controlling of the gas temperature requires a significant volume fraction of fluidized material in the reaction chamber as a whole, the requirements of good horizontal mixing and good temperature control are mutually irreconcilably inconsistent in all fluidized-bed reactors. The said inconsistency is in fact an unavoidable and fundamental problem of combustion reactors based on fluidized-bed technology.

The problem of poor horizontal mixing concerns especially the gas formed as a result of the thermal degradation of fuel in the fluidized bed. It discharges from the fluidized bed in the vicinity of the fuel supply means as a vertical, low-oxygen jet barely mixing with the fluidizing air. A functional disadvantage of bubbling fluidized-bed reactors in particular is that especially with dusty, wet fuels which contain an abundance of vaporisable compounds, combustion shifts excessively to the area above the fluidized bed, where there is only a small amount of fluidized material preventing the temperature from rising. As a result, the temperature in the upper part of the combustion chamber increases excessively and the temperature in the fluidized bed remains too low, which may result in ash burning in the upper part of the combustion chamber and/or the extinguishing of the combustion chamber.

In bubbling fluidized-bed reactors, problems with temperature control are also faced if the fuel has a coarse particle size and contains only a small amount of vaporisable compounds, in which case combustion takes place mainly in the fluidized bed. An excessive rise in the temperature of the fluidized bed then becomes a problem. For the foregoing reasons, in a combustion device based on an bubbling fluidized bed can only be burned the type of fuels with which the said problems are controllable, which prevents or restricts the use of more economical fuels. Poor control of the combustion process also increases the monitoring and maintenance costs of the boiler and causes expensive interruptions in use.

In the publication U.S. Pat. No. 5,257,585 is disclosed a solution which aims at eliminating the mixing problem between unburned gas from bubbling fluidized-bed reactors and oxygen. In it, in the centre of a vertical combustion chamber is arranged a throttling which decreases the horizontal cross-section of the combustion chamber, whereupon the combustion chamber can be thought to be divided into two superimposed sections. By means of the throttling, the aim is to guide the gas flows in such a way that mixing in the upper section improves. Although the concentrations of unburned compounds in the gas discharging from the reactor can thus be reduced by means of the invention, it does not, however, solve the above-mentioned fundamental disadvantages of bubbling fluidized-bed reactors.

In circulating mass reactors, on the other hand, the aim has been to reduce the said problems of bubbling fluidized-bed reactors by deliberately increasing the volume fraction of fluidized material in the upper part of the combustion chamber, whereupon the fluidized material escaping from the combustion chamber has to be returned to the fluidized bed. Separation and returning devices then have to be added to the reactor. The temperature control problems of bubbling fluidized-bed reactors can be avoided when operating close to nominal output, as long as the circulating mass flow of fluidized material is sufficient.

In circulating mass reactors, the preferable gas velocity calculated in accordance with the horizontal cross-section is typically 5-6 m/s. This means that already with part loads of 50%, the circulating mass flow falls to an insignificant level and the circulating mass reactor begins to function like bubbling fluidized-bed reactors, with the above-mentioned problems.

Since in circulating mass reactors a significant volume fraction of fluidized material has to be allowed also in the upper part of the combustion chamber to balance temperature differences, the poor horizontal mixing of gas in the combustion chamber of the circulating mass reactor becomes a problem. As in bubbling fluidized-bed reactors, the mixing problem is emphasized when burning fuels containing an abundance of fine fractions and/or vaporisable compounds.

It is in addition characteristic of both of the above-mentioned reactor types that in them, temperatures are in practice determined only by the quality and amount of the fuel without it being possible to affect them essentially through adjustment measures. Especially changes in humidity, which are typical of biomasses, cause problems in both bubbling fluidized-bed boilers and circulating mass boilers.

Their further joint fundamental disadvantage is that the cooling of the furnace takes place by means of heat transfer surfaces, whereby the cooled wall surfaces of the combustion chamber, typically used for vaporising the circulation water, bring about an uncontrollable heat loss. This increases the lowest permissible effective heat value of the fuel used significantly, which limits the range of fuels usable in the boiler, that is, the flexibility of fuels.

Another joint fundamental disadvantage of the said reactors is that in them, the heat transfer surfaces, especially the superheater, come into direct contact with the corrosive compounds of fuel ash. To reduce the corrosion of the superheaters, the temperature of the superheated steam has to be limited, as a result of which the electric supply of the power plant decreases. Also in this respect biomasses, among others, are problematic. With current boiler types, sulphurous additional fuels—in Finland usually peat—have to be used when burning biomass to protect the superheaters from ash corrosion. The said disadvantages are particularly problematic when burning materials classified as waste.

A further problem involved in the direct cooling of the furnaces of CFB boilers is that a bad compromise has to be made between the height of the furnace and the conveyance of the fluidized material, and that the power density (MW/m3) of the furnace remains low, which makes the furnace unnecessarily large and expensive. As a result of the compromise, the furnace is rendered high and the required fluidized material circulation can only be maintained close to nominal output. Another disadvantage of CFB boilers is that the external separator and return conduit fitted alongside the furnace increase the space requirement and price of the boiler significantly.

To improve the temperature control of circulating mass reactors, proposals have been made to connect various heat exchangers in conjunction with the return conduits of the circulating material. Solutions fitted in the return conduits of the circulating material have, in addition, been based on fluidized-bed technology which has brought on several problems, which are listed in the following.

Firstly, a fundamental problem of heat exchangers fitted in the return conduits of circulating material in circulating mass reactors is the insufficient circulating mass flow of fluidized material. This problem is due to the unavoidable inconsistency in vertical combustion chambers between the delay time required by combustion and the requirements set by the conveyance of circulating material. The said problem becomes particularly overwhelming when the boiler has to be used on part load, that is, with partial power output.

Secondly, even if the above-mentioned heat exchangers fitted in the return conduits could be made to operate satisfactorily close to the nominal output, they will not eliminate the limitation of the heat transfer surfaces fitted in the furnace for the lowest permissible effective heat value of the fuel used in the boiler. The cooling surfaces fitted in the combustion chamber unavoidably limit the flexibility of fuels of the boiler and are susceptible to soiling, wear and corrosion.

Moreover, a fluidized-bed cooler as such is expensive and complex from an equipment-technical point of view and its pipe system is subjected to extremely strong erosion. The adjustment of the circulating material flow is also difficult to carry out in a functioning manner in them.

Furthermore, the internal consumption of the fluidized-bed cooler is high and the fluidizing gas required creates an additional heat requirement in the heat exchanger. This emphasises further the problem of the already insufficient circulating material flow. An additional challenge is presented by the fact that the fluidizing gas in the heat exchangers fitted in the return conduits must be conducted away from the heat exchanger in such a way that it will not essentially hinder the operation of the particle separator.

For the above reasons, among others, it has generally been necessary to give up the process-technically sensible fluidized-bed heat exchangers fitted in the return conduits of circulating mass reactors.

In the publication U.S. Pat. No. 4,672,918 is disclosed an idea for improving temperature control in a circulating mass reactor. The said reactor is based on a recuperatively cooled combustion chamber known as such. In it, the circulating mass is divided into two parallel return conduits, one of which comprises heat transfer surfaces. Even at best, the said solution can only provide partial improvement to the temperature control of circulating mass reactors. It does not, however, eliminate or diminish the other fundamental disadvantages of circulating mass reactors described above.

According to the publication, the circulating mass flow in a cooled return conduit in the return conduit would be adjusted by a mechanical device fitted in the upper part of the return conduit. This would lead to numerous problems. Firstly, a mechanical actuator is subjected to intensive wear and corrosion. Secondly, the velocity of freely falling circulating mass would become high, which would cause rapid wear of the heat transfer surfaces. Furthermore, in order for it to be possible to fit an amount of heat transfer surface significant from the point of view of temperature control in the return conduit, the cross-section of the cooled return conduit should be large. The gas flow passing through the return conduit to the cyclone would then increase to problematic proportions and the ash compounds carried along with the gas would cause corrosion of the heat transfer surfaces, especially of the superheater. Dividing the circulating mass sufficiently evenly over the cross-section of the cooler would not be possible in practice. Even at its best, the cooling device according to the invention would only function when operating with part loads of over 50%, because with lower outputs, there will not be enough circulating material in the cooled return conduit.

However, an even greater disadvantage of the solution disclosed in the publication U.S. Pat. No. 4,672,918 is that heat transfer surfaces are fitted in the reactor's furnace. They unavoidably reduce the flexibility of fuels, especially with part loads. As appears, for example from FIG. 1, the walls of the furnace are implemented as cooled panel structures, indicating that the cooling of the reactor is intended to take place mainly through the wall surfaces of the furnace. The said solution does not solve in any way the above-mentioned fundamental and essential problems of combustion control. Furthermore, the reactor according to the publication would result in an expensive construction requiring ample maintenance.

In patent applications FI20031540 and WO2009022060 is disclosed an essentially axial-symmetric circulating mass reactor, hereinafter CTC reactor (Constant Temperature Combustion), where in two or more parallel fluidized material return conduits is fitted a recuperative intermediate circulation cooler, from the circulating material returning from which heat is transferred to a liquid, steam or gas. In intermediate circulation coolers, the circulating material is in a compacted state in the heat exchanger and by means of an intermediate circulation cooler, the cooling of the reactor is adjusted as the set temperature value at a chosen point in the reactor. The initial temperature of the flow receiving the heat is adjusted by means of other intermediate circulation coolers.

In a CTC reactor, combustion and the conveyance of the circulating material takes place in the same vertical combustion chamber, and thus in order to limit the height of the reactor, a bad compromise has to be made between a sufficient delay time from the point of view of combustion and the gas velocity required by the conveyance of the circulating material. In order to obtain a sufficient solids flow even within a reasonable part load range, the delay time of the fuel particles in the riser conduit fitted in the centre of the CTC reactor after the combustion chamber has to be limited to a level insufficient for combustion.

Therefore, a prerequisite for the satisfactory operation of a CTC reactor is that combustion can be made to take place almost completely before the cyclone. The shifting of combustion into the cyclone chamber would result in a detrimental increase in gas temperature, because there the volume fraction of fluidized material is approximately zero. The thermal energy from postcombustion transferred to the cyclone is also not available for maintaining the temperature in the reactor's combustion chamber. This results in a limitation of the flexibility of fuels; especially the autogenous combustion of humid materials causing intensive postcombustion cannot be carried out in CTC reactors, even if the heat value of the material would allow it. Postcombustion in the cyclone also increases the maintenance costs of the structures of the reactor and shortens their life. This problem is worsened by the axial-symmetric structure of the CTC reactor, due to which the coke- and hydro-carbon-containing gas produced in the vicinity of the fuel supply means as a result of the thermal degradation of fuel and the oxygenous gas distributed evenly over the entire nozzle base mix poorly before the riser conduit.

Although in a CTC reactor, the heat transfer can be adjusted close to the nominal output and the soiling and corrosion problems of the superheaters have been solved, the above-mentioned disadvantage of a CTC reactor is that the furnace has to be designed as a compromise of the inconsistent requirements of the combustion process and adiabatic cooling. Single-step separation of fluidization material can also be considered a disadvantage of CTC reactors, because the large volume fraction of the gas coming into the cyclone causes erosion of the structures and increases the penetration of solids. A problem with the structure of the CTC reactor is also the riser conduit, which is difficult to implement in cooled form, especially in small reactors, and which, when uncooled, especially when burning corrosive, ash-containing substances, increases the service and maintenance costs of the reactor.

Following the rise in the price of fossil fuels, it would be cost-effective for power plants to use the poor-quality fuels available, but this is not possible for the above reasons.

PURPOSE AND SOLUTION OF THE INVENTION

The aim of the invention is to provide a solution by means of which the above-mentioned deficiencies of the prior art, the most significant of which are the insufficient flexibility of fuels and the corrosion of the superheaters, could be diminished or completely avoided. A further aim of the invention is to reduce the size and manufacturing costs of circulating mass reactors.

The characteristics of the method according to the present invention for achieving this aim are disclosed in the characterising part of claim 1. The circulating mass reactor for implementing the method according to the invention is in turn characterised by what is disclosed in the characterising part of claim 10. Furthermore, preferred embodiments of the invention are disclosed in the dependent claims.

The problems of the CFB reactors and CTC reactors described above are basically due to the fact that they aim to carry out combustion, cooling and the conveyance of the circulating mass in the same, essentially vertical combustion chamber, which unavoidably results in a bad compromise with the disadvantages described above.

The present invention essentially eliminates the disadvantages of the known combustion devices and methods described above. That is to say, to avoid the deficiencies described above, the combustion process, the conveyance of the heat carrier particles acting as the heat carrier particles of the fluidized material and the cooling of the furnace have now been arranged as separate functions independent of one another. In order to achieve this, the reactor furnace, where the oxidation of the fuel takes place essentially completely, is divided into two separate combustion chambers, a lower one and an upper one, in such a way that efficient mixing and a sufficient delay time are achieved in them.

The primary function of the lower combustion chamber is ignition and mixing and that of the upper combustion chamber is the completion of combustion. The purpose of the riser conduit connecting the combustion chambers is only to lift the fluidized material flow required for the adiabatic cooling of the combustion chambers from the lower combustion chamber to the upper combustion chamber. The cooling of the combustion chambers takes place adiabatically, by means of fluidized material cooled outside the combustion chambers, whereby no soiling, wearing and corroding heat transfer surfaces need to be placed in the combustion chambers and the temperature of the combustion chambers can be controlled by regulating the flow of the cooled fluidized material.

In the constructive sense, the invention is characterised in that on the one hand the lower and upper combustion chamber, and on the other hand the separator devices for separating the fluidized material and the return conduits of the fluidized material are positioned in layers, one upon the other, in such a way that the lower combustion chamber is the lowest, on top of it and parallel to each other are the riser conduits and the entity comprised of the separator apparatus and the return conduits, and topmost is the upper combustion chamber. In this way is achieved an advantageous and particularly compact construction from the point of view of manufacturing technique.

The sufficient cooling of combustion gases, and finally of flue gases, in the combustion space takes place essentially adiabatically by means of heat carrier particles. In connection with the combustion chambers are, therefore, not provided heat transfer surfaces, at least not to any essential extent, but the combustion chambers, as well as the flow conduit between them are protected from wear and from cooling detrimental to the flexibility of fuels most preferably by thin gunning. Heat transfer outside the system takes place essentially from the fluidized material separated from the flue gases into a medium flowing in heat exchangers fitted in the return conduits of the circulating mass, the said medium usually being water and/or water vapour. Heat may also be transferred into a gas or powder.

Since in the arrangement according to the invention, no technical requirements concerning combustion or heat exchange need to be made on the riser conduit, it can now be dimensioned solely on the terms of the conveyance requirements of the heat carrier particles. The flow velocity of the gas in the riser conduit can be dimensioned freely in such a way that the fluidized material flow determined by the requirements of adiabatic cooling can be maintained also with low part loads.

THE ADVANTAGES ACHIEVED WITH THE INVENTION

By means of the arrangement according to the invention is achieved maximum flexibility of fuels and the heat transfer surfaces required for cooling the reactor are protected from soiling, wear and corrosion. The circulating mass reactor applying the idea of the invention is also structurally both very simple and particularly compact and thus also economical to manufacture.

More of the advantages provided by the solution according to the invention appear from the following preferred embodiments of the invention.

LIST OF FIGURES

Figure 3:
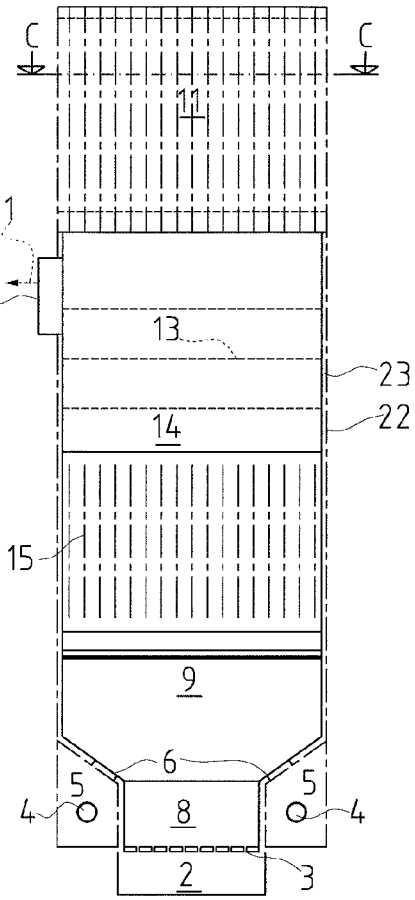
Figure 2:
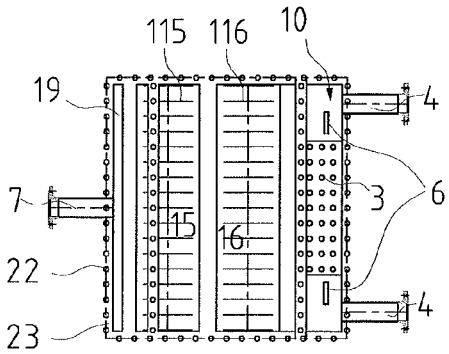
Figure 4:
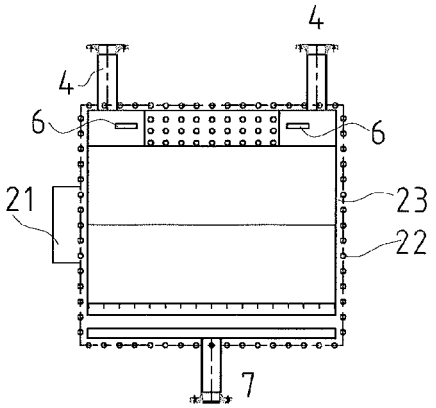

The invention is described in greater detail in the following with reference to the drawings, in which:

FIG. 1 shows a sectional view of the circulating mass reactor according to the invention, as seen from the side, FIG. 2 shows the circulating mass reactor of FIG. 1 as a longitudinal cross-section along line A-A, FIG. 3 shows the circulating mass reactor of FIG. 1 as a transverse sectional view from above, along line B-B, and FIG. 4 shows the circulating mass reactor of FIG. 1 as a transverse sectional view from above, along line C-C of FIG. 2.

LIST OF REFERENCE NUMERALS

The method according to the invention for burning fuel in a circulating mass reactor can be implemented by means of the device according to the embodiment shown in FIGS. 1-4, the reference numerals of which are listed in the following:

| | |
|---|---|
| Circulating mass reactor | 1 |
| Fluidizing air chamber | 2 |
| Distribution nozzles for fluidizing air | 3 |
| Secondary air supply means | 4 |
| Secondary air chamber | 5 |
| Air distribution nozzles for secondary air chamber | 6 |
| Fuel supply means | 7 |
| Fluidized-bed chamber | 8 |
| Upper combustion space and mixing chamber comprised in the lower combustion chamber | 9 |
| Riser conduit | 10 |
| Upper, i.e. latter combustion chamber | 11 |
| Separator inlet | 12 |
| Separator air deflector | 13 |
| Upper part of return conduit system | 14 |
| Vaporising return conduit | 15 |
| Superheating return conduit | 16 |
| Actuators of vaporising return conduit | 17 |
| Actuators of superheating return conduit | 18 |
| Uncooled return conduit | 19 |
| Swirl chamber of separator | 20 |
| Central pipe | 21 |
| Load-bearing structures | 22 |
| Heat insulators | 23 |
| Fluidized material | 80 |
| First combustion chamber | 89 |
| Fluidized bed | 108 |
| Riser conduit 10 feed opening | 110 |
| Superheater heat exchangers | 115 |
| Vaporizer heat exchangers | 116 |
| Separator | 120 |
| Flow of primary air through fluidized bed | 138 |
| Primary air flow | 153 |
| Secondary air flow | 156 |
| Flow through riser conduit | 160 |
| Planned main flow path in upper combustion chamber 11 | 166 |

-continued

| | |
|---|---|
| Swirl of flue gas and fluidized material suspension in separator chamber | 170 |
| Flue gases out from the separator | 171 |
| Preferred path of fluidized material through separator chamber | 180 |
| Path of flue gases and fluidized material suspension | 189 |
| Boundary layer of upper combustion chamber and interspace | 201 |
| Boundary layer of lower combustion chamber and interspace | 202 |
| Interspace zone | 203 |
| Fluidized material overflow past cooled return conduits | 280 |

DETAILED DESCRIPTION OF THE INVENTION

FIG. 1 shows a circulating mass reactor 1 which comprises, in accordance with the prior art, a fluidizing air chamber 2 and distribution nozzles 3 for fluidizing air arranged therein, through which primary air is blown into the fluidized-bed chamber 8 through a fluidized bed 108 arranged at its bottom. Secondary air is supplied through a secondary air chamber 5, through air distribution nozzles 6, to a combustion zone 9 above the fluidized bed 108.

Fuel supply takes place from the end of the fluidized-bed chamber 8, through a suitable fuel supply means 7. As fuel can be used any known materials based on both fossil and renewable fuels and their mixtures. The circulating mass reactor can be used for heating, vaporising as well as superheating a heat transfer liquid arranged to flow in heat transfer liquid circulation (not shown) arranged to circulate through it, for preheating combustion air and generally for other known uses of a combustion reactor.

The flow of flue gases and fluidized material discharging from the combustion chamber 11 is lastly guided to a separator, where the fluidized material is separated from the flue gases. The fluidized material is returned to the fluidized-bed chamber 8 and the flue gases are removed from the reactor through means 21. FIG. 1 further shows, among others, load-bearing structures 22 and insulation fittings 23.

In the following are discussed in greater detail the central features of the invention, specifically by means of the problems described above as the problems of circulating mass reactors and which the invention aims at solving. In addition to the problems of conveying fluidized material, the common challenges of combustion reactors and at the same time problems to be solved relate to the prerequisites of good combustion control presented in the following from both the heating and flow technological point of view:

1) possibility to adjust the cooling of the combustion chamber or chambers on the basis of varying fuel quality and combustion reactor output, that is, part load,
2) with fluidizing reactors, the possibility of maintaining the volume fraction of heat carrier particles required for stabilising the temperature in the combustion chamber also with partial outputs, and
3) efficient mixing of fuel and oxygen in the combustion chamber and sufficient delay time for the combustion of the particles.

From the requirement of point 1) follows that the cooling of the combustion chamber cannot be based on direct radiant and convective heat exchange from gas and heat carrier particles to cooling surfaces fitted in the combustion chamber without reducing the flexibility of fuels of the reactor. A central characteristic of the combustion method according to the invention relates specifically to this problem.

The invention is characterised, firstly, in that the spaces involved in combustion, that is, the lower combustion chamber 89 with the fluidized-bed chamber 8 and the combustion zone 9 above it, the riser conduit 10, the combustion chamber 11 and preferably also the separator device 120 used for the separation of fluidized material with the separation chamber are essentially uncooled, in other words, the flow in them takes place adiabatically. It is, therefore, also characteristic that temperature control in these spaces is based on fluidized material, that is, on cooling brought about by heat carrier particles. The cooling of the heat carrier particles, on the other hand, does not take place until in the fluidized material return conduits 15, 16, where the vaporisation and/or superheating of the circulation water or other suitable heat transfer agent is carried out by means of the heat exchangers 115, 116. In the said reactor parts, direct contact cannot, therefore, take place between the suspension and the heat transfer surfaces, which would bring about a heat loss of the order of 100 kW/m2, reducing the flexibility of fuels of the reactor.

The requirements set in points 2) and 3) above are also fundamentally mutually inconsistent. The high gas velocity required in point 2) is unavoidably inconsistent with the sufficient delay time required in point 3). The present invention provides a solution also to this problem. More specifically, the combustion process and the conveyance of the heat carrier particles become separate procedures independent of one another.

The fuel ignites in the fluidized-bed chamber 8 and in the combustion space 9 above it, the combustion air, gasified fuel and coke particles mix efficiently. The fluidized-chamber 8 and the combustion space 9 together form the lower combustion chamber 89. The clearly upwards directed gas flow of the fluidized-bed chamber turns in the combustion space 9 above it essentially in the horizontal direction towards the riser conduit 10. The gases and the heat carrier particles are conducted into the riser conduit 10. The main function of the lower combustion chamber 89 is to ignite the fuel and to provide good mixing of oxygen, gasified fuel and coke. Compared with, for example, the arrangements disclosed in the publications U.S. Pat. No. 4,672,918 and WO2009022060, the advantage of the arrangement according to the lower combustion chamber 89 is now that even the shortest possible delay time of the fuel particles in the fluidized bed is maximized. Combustion is completed in the upper combustion chamber 11. Thus, the riser conduit 10 can now be dimensioned solely on the terms of the conveying need of the heat carrier particles.

Since the combustion-technical requirements—mainly the delay time—can thus be practically disregarded as concerns the riser conduit, the gas velocity in the conduit can be dimensioned purely on the basis that a sufficient heat carrier flow can be conveyed also with a partial output, whereby the flow of flue gases, and thus also the flow velocity, will inevitably fall with respect to the gas flow with nominal output.

The completion of the combustion process in the combustion chamber 11 following the riser conduit 10 is ensured with its sufficient dimensioning.

The overall constructive idea of the invention appears best from FIG. 1. As concerns the overall structure of the reactor, the reactor according to the invention is characterised in that the riser passage 10, and on the other hand the entity formed by the separator apparatus 120 and the return conduit system 15, 16, 19, connecting the lower and upper combustion chamber 89, 11 are located vertically essentially between the combustion chambers and thus at the same time parallel to each other. In a preferable arrangement, the separator or swirl chamber 20 of the separator device 120 and the return conduit system 14, 15, 16, 19 connected to it essentially over its entire lower side on the open lower surface or bottom are fitted parallel to the essentially vertical riser conduit 10 in such a way that the lower combustion chamber 9, the return conduit system 14, 15, 16, 19 above the combustion chamber 9, the swirl chamber 20 above the return conduit system, and the combustion chamber 11 form a four-layer, essentially superimposed construction in the said order starting from the bottom.

When the lower combustion chamber 89 and the upper combustion chamber 11 are designed and dimensioned in such a way that they together suffice to complete the combustion, the riser conduit 10 connecting the ends of the combustion chambers has been made much narrower than the upper and lower combustion chamber, whereby it has been possible to utilise the space that has become available between the lower and upper combustion chambers for locating the essentially horizontally extending separator device 120 and the return conduit system 15, 16, 19. This is illustrated further in FIG. 1 with imaginary borders in principle provided with reference numerals 201 and 202. The reactor is thus divided into three zones, whereupon the interspace zone remaining between the border 201 in principle between the lower combustion chamber 89 and the interspace, and correspondingly the border 202 in principle between the upper combustion chamber 11 and the interspace, between the combustion chambers 203 can now be used as described above for locating the riser conduit 10 and the separator device 120 and the return conduit system 15, 16, 19.

Furthermore, by means of the preferred construction of the combustion chamber, which utilises the two-way flow of flue gases and fluidized material, it is further possible to enhance mixing and to reduce the space required by the circulating mass reactor as a whole, as illustrated by means of the planned suspension flow paths 161. An even more compact structure is obtained when a horizontal arrangement is used for the separator device 120, where a turbulent flow formed in a separator chamber based on centrifugal force advances around an essentially horizontally extending shaft.

In this way is achieved a particularly compact construction, which at the same time both makes possible a sufficiently long delay time for the flue gases and on the other hand ensures a sufficiently high flue gas flow velocity to guarantee efficient and uninterrupted conveying of the fluidized material in all running situations.

Details and Preferred Embodiments of the Invention

In the foregoing is described the central operating idea of the construction according to the invention and its main features. In the following, individual devices of the combustion reactor according to the invention are discussed in greater detail and at the same time are disclosed more features of the different embodiments of the invention and the advantages they bring about. In accordance with the foregoing, a preferred embodiment of the combustion method according to the invention thus comprises basically the following main stages:

1. Supplying of fuel into the fluidized-bed chamber 8 and its gasification in the fluidized-bed chamber 8 and its fluidized bed 108.
2. Partial or, especially with a part load, even complete oxidation of the gasified fuel in the first combustion chamber 89, which comprises a fluidized-bed chamber 8 and preferably a mixing and combustion space 9 above it.
3. Pneumatic conveyance of combustion gas and heat carrier particles by means of the flue gas flow in the riser conduit 10 to the upper combustion chamber 11.
4. Completion of burning especially in the case of a part load at latest in the combustion chamber 11.
5. Separation of gas and the heat carrier particles in the separation chamber 13, 14.
6. Returning of the separated heat carrier particles to the fluidized bed 8 through the return conduits 15, 16, 19.
7. Transfer of heat bound in the heat carrier particles to the circulation water in heat exchangers 115, 116 located in the return conduits for this purpose.

The main functions of the fluidized-bed chamber 8 are the horizontal conveyance of the powdery heat carrier material 80 coming from the return conduits 15, 16, 19 in the direction of the riser conduit 10 and the processing of the solid fuel coming through the supply devices 7 into gas and small coked particles. Device-technically, the fluidized-bed chamber 8 is a heat-insulated chamber known as such, most preferably essentially the shape of a rectangular prism. The fluidizing air is conducted through fluidizing air nozzles 3 fitted in the lower part of the fluidized-bed chamber.

In the embodiment shown in FIGS. 1-4, the fuel supply devices 7 are preferably fitted to the opposite end of the lower combustion chamber 89 with respect to the riser conduit 10, whereby the shortest possible delay time of the fuel particles in the fluidized bed 108 is maximised. The heat carrier flow returning to the fluidized bed through uncooled return conduits 19 is most preferably guided to the immediate vicinity of the fuel supply devices 7, where the consumption of thermal energy is highest due to the drying and thermal degradation of the fuel.

A further advantage of this arrangement is that the major part of the gas produced in the vicinity of the supply devices 7 as a result of thermal degradation and the fine fraction of the fuel are conveyed rapidly from the fluidized-bed chamber 8 to the combustion space 9 above it. In it, the flow has already turned into an essentially horizontal flow. Their delay time in the combustion chamber 89 is thus maximised and mixing with the secondary air 6 provided in conjunction with the combustion space is as efficient as possible. The secondary air nozzles 6 provided in the mixing space 9 can be fitted in many ways on the inner surfaces of the mixing space. FIG. 3 shows, by way of an example, an arrangement of the secondary air nozzles 6 on opposite sides of the fluidized-bed chamber 8 at the bottom of the mixing space.

In the fluidized-bed chamber 8, the vertical fluidization velocity of the gas is set in such a way that a sufficient delay time is obtained for the fuel particles. The fluidizing air flow required by complete gasification of the fuel is typically 20-30% of the overall air flow. The cross-sectional surface of the horizontal plane of the fluidized-bed chamber 8 is dimensioned in such a way that the fluidization velocity of gas calculated on the basis of it is 0.5-1.5 m/s.

In the circulating mass reactor type combustion device according to the invention, the lower combustion chamber 89 is thus comprised of a fluidized-bed chamber 8 and of a mixing and combustion space 9 fitted preferably immediately above it. In the combustion space, the volume fraction of the fluidized material is essentially smaller than in the fluidized bed, most preferably 1-5%. It should be noted that in the riser conduit 10, the volume fraction of the fluidized material is preferably less than 1% and in the upper chamber 11 less than 3%. The combustion space 9 is a thermally insulated, essentially horizontal chamber, which is preferably essentially rectangular in cross-section on the vertical plane, the height of the chamber being dimensioned in such a way that the vertical gas flow from the fluidized-bed chamber 8 and the air from the secondary air nozzles provide a significant horizontal velocity component in the combustion space 9 towards the lower end of the riser conduit 10.

The central task of the mixing chamber 9 is in fact to ensure the efficient mixing of the, especially gasified, fuel rising from the fluidized-bed chamber 8 and the secondary air before the riser conduit 10.

Although the present application discusses separately a fluidized-bed chamber 8 and a combustion or mixing chamber 9, the question is, as shown in FIG. 1, preferably of a uniform space, that is, of a lower combustion chamber 89 which is divided functionally into zones on the basis of the special function or functions arranged in them. For the sake of clarity, the present application discusses a fluidized-bed chamber 8, in which a fluidized bed 108 is located, and a combustion or mixing chamber 9, where the supply of secondary air and its mixing with the combustion gases take place in order to homogenise the gas mixture in the combustion chamber and to enhance the combustion process taking place mainly in the upper combustion chamber 11.

In the mixing chamber 9, the main direction of flow of the gas is thus horizontal and depending on the distribution of the secondary air, the horizontal velocity of the gas increases in the mixing chamber 9, when proceeding from the fuel supply devices 7 in the direction of the riser conduit 10. The velocity increases from practically a zero velocity most preferably to a value of 5-10 meters per second. With a full load, the velocity may be even greater, as high as 20 m/s, and with a part load correspondingly lower, even as low as about 3 m/s.

In the mixing chamber 9, the horizontal pressure is essentially constant, which means that the penetrability of the free jets produced by the nozzles 6 is sufficient to bring about efficient mixing of the secondary air and the gasified fuel rising from the fluidized-bed chamber. The volume of the lower combustion chamber 89 is most preferably dimensioned in such a way that the specific volume in the lower combustion chamber (volume/output), calculated on the basis of the effective heat value of the fuel, is most preferably 4.0-0.4 m3/MW.

The only function of the riser conduit 10 is to convey a sufficient heat carrier flow to the combustion chamber 11 over the entire output range, and thus the riser conduit can be dimensioned solely on a flow-technical basis. Structurally, this type of flow conduit 10 is essentially a vertical, thermally insulated conduit having a cross-section of a rectangular or other suitable shape, which is dimensioned in such a way that the gas velocity in the riser conduit with the required minimum output is greater than the critical velocity of the pneumatic conveyance of the heat carrier particles. The rate of flow of the heat carrier particles in the riser conduit is set so as to be sufficient for the temperature control of the combustion process by adjusting the amount of heat carrier particles in the reactor.

Conveying the heat carrier particles in the riser conduit 10 requires that the velocity of the gas at the lowest partial output required is greater than the velocity of the free fall of the heat carrier particles (terminal velocity). In practice, the said terminal velocity is of the order of 2-3 m/s, so that if the combustion device is to operate in the planned manner, for example with a partial output of 20%, the horizontal cross-sectional flow area of the riser conduit should be dimensioned so that the gas velocity would settle to a nominal output of 10-15 m/s.

The riser conduit 10 is in practice preferably dimensioned so that the ratio of the average free surface of its horizontal cross-section to the average free surface of the vertical cross-section of the upper part 9 of the lower combustion chamber 89 is less than 0.5 and most preferably 0.3-0.15. The height or length of the riser conduit is determined by following these values in accordance with the rest of the construction and layout. With a nominal output of the riser conduit, the heat carrier flow required due to the high gas velocity is achieved with a low pressure loss, due to which the internal consumption of the boiler is minimised.

The function of the upper combustion chamber 11 is above all to bring the combustion process following the riser conduit 11 to an end. Its volume must, therefore, be dimensioned in such a way that the as yet unburned gases and coke particles being conveyed from the riser conduit 10 to the combustion chamber have time to become completely oxidized in all load situations and with varying fuel quality.

Complete oxidation thus refers to the normal level of fuel particle oxidation which is generally reached in combustion reactors and steam boilers. Once combustion has been brought completely to an end, a thermodynamic equilibrium determined by the material flows supplied in the reaction space, temperature and pressure has been reached, but in practice the equilibrium can only be approached asymptotically in technical reactors. A small proportion (less than 1%) of the basically oxidizable amount of fuel material will always remain unburned. In the technical sense, combustion may, therefore, be considered completed when the concentration of all the compounds of the gas discharged from the reactor corresponds to the concentration complying with the equilibrium with the required accuracy, a sufficient accuracy in most cases being about 1-2%.

To ensure complete oxidation, the volume of the upper combustion chamber is dimensioned in such a way that the average delay time of the flue gas in the upper combustion chamber (volume of combustion chamber/volume flow of gas) is most preferably 1.0-3.0 seconds at nominal output. In combustion chamber design should at the same time be ensured that a sufficient heat carrier flow is conveyed at the required minimum output through the combustion chamber, all the way to the separator device 120. Should the combustion gas and the heat transfer particles be removed through an outlet fitted in the upper part of the combustion chamber 11, the above-mentioned fundamental inconsistency between the required combustion delay time and the heat carrier flow would be faced after the riser conduit.

To avoid this inconsistency, in the combustion device according to the invention the gas and the heat carrier particles are discharged through a means 12 fitted in the lower part of the combustion chamber 11. The upper combustion chamber is preferably made in such a way that the flow is able to turn in an essentially opposite direction with respect to the supply direction before discharging from the chamber. The flow of flue gases and heat carrier particles from the riser conduit 10 is first directed essentially vertically upwards, after which the vertical directions of flow finally turn vertically downwards towards the separator device 120 in the upper parts of the combustion chamber.

The vertical flow coming from the riser conduit 10 behaves essentially like a free jet in the combustion chamber 11, as a result of which the gas pressure in the combustion chamber 11 is essentially constant. By means of the said combustion chamber 11 arrangement is achieved efficient mixing of the flue gases and the fluidized material, due to which oxidation is efficient and the volume fraction and rate of flow of the heat carrier particles remain sufficient for the temperature control of the gas in the whole of the combustion chamber.

Furthermore, the delay time in the combustion chamber 11 becomes sufficiently long for completing combustion before the flue gases and fluidized material are guided to the separator device 120. The combustion chamber 11 is preferably dimensioned in such a way that combustion can essentially be completed in the combustion chamber 11 before the separator device means 12, in such a way that with a nominal load, more than 30% of the heat energy generated by the combustion of the fuel burned in the reactor is not released until in the upper combustion chamber 11. With a part load the percentage is obviously smaller. It is even possible that the fuel is then completely oxidized before arriving in the upper combustion chamber 11.

Another essential aspect of the arrangement according to the invention is the adiabatic nature of the flow of the flue gases and the fluidized material. In other words, the cooling of the combustion chamber 89, the upper combustion chamber 11 and the riser conduit 10 connecting them takes place mainly adiabatically by means of the fluidized material circulating in them, which is cooled in the return conduits 15, 16. The amount of heat transferred outside the system, mainly through the walls, is very small, typically of the order of 1 kW/m2, whereas in conventional combustion chamber solutions with heat exchangers it is of the order of 100 kW/m2. The chambers and the flow conduit between them are dimensioned and insulated in such a way that the net heat flow transferred to the walls of the said reactor parts by conduction and radiation, among others, is less than 50%, preferably less than 30%, and most preferably less than 10% of the heat output required, for example, for maintaining the temperature of the flue gas discharging from the reactor, or of the fluidized bed, at the desired set value.

The function of the separator device 120 is, for its part, to separate the heat carrier particles from the flue gases, to guide the separated particles into the return conduits 15, 16, 19 and to discharge the flue gases from the combustion device, for example, for heat recovery and purification. The particle separator 120 is preferably comprised of an essentially horizontally extending separator chamber 20, at one or both ends of which is fitted a gas outlet 21.

The preferably rectangular inlet 12 of the separator device is fitted in the lower part of the combustion chamber 11, preferably in such a way that the downwards directed flow in the combustion chamber is able to continue directly into the separator chamber 20. The advantage of the arrangement is that the velocity of the fluidized material to be separated is greater in the means 12 than the velocity of the gas. The flow is moreover preferably arranged in such a way that the flow is directed through the inlet at the chamber 20 in an essentially tangential manner. This both enhances the formation of a turbulent flow and on the other hand facilitates the directing of the fluidized material flow directly forward through the open bottom of the chamber 20 into the upper part 14 of the return conduit system. The ratio of the free surface of the opening connecting the swirl chamber 20 to the upper part 14 of the return conduit system to the largest horizontal cross-section of the swirl chamber is even at its smallest point preferably greater than 0.7. The cross-section of the conduit is preferably essentially uniform.

Below the separator inlet may in addition be a suitable air deflector 13, by means of which the essentially horizontal turbulence forming in the swirl chamber 20 can be influenced. According to this embodiment of the invention, the particle separator is in addition characterised in that it is fitted alongside with the riser conduit 10, between the upper combustion chamber 11 and the lower return conduits 15, 16, 19, as disclosed above with reference to FIG. 1.

A downwards directed flow of gas and heat carrier particles coming most preferably at a velocity of 5-15 m/s from an inlet 12 fitted tangentially on the edge of the swirl chamber 20 forms a strong, essentially horizontal turbulence in the horizontal swirl chamber 20 when directed to the outlet 21. Due to the effect of the turbulence in the swirl chamber, in the lower part of the separator chamber is formed a separate slow flow inductive turbulence, where the flow velocities are low and the upper part 14 of the return conduit system, therefore, acts as an efficient settling chamber.

The main part of the heat carrier particles coming from the inlet 12 (over 99%) in fact continues its movement due to the effect of inertial and gravitational force directly to the upper part of the return conduit system, as illustrated by arrow 180 which depicts the route. Only a small part of the particles is conveyed into the swirl chamber 20 with the turbulent flow 170 generated. There they are concentrated due to the effect of centrifugal acceleration on the wall surfaces of the swirl chamber 20 and are conveyed from there by the effect of gravitational and centrifugal acceleration from the bottom of the swirl chamber 20 which is completely open on its lower side to the upper part 14 of the return conduit system. Advantages of the described separator arrangement are, among others, that the velocity of the particles to be separated is higher at the inlet 12 than the velocity of the gas (4-7 m/s higher), and the completely open cross-sectional surface of the upper part 14 of the swirl chamber 20, which together bring about efficient separation of the heat carrier particles, which has been verified by flow modeling tests.

In the upper part 14 of the return conduit system, the flow into the return conduits 15, 16 can be controlled in a regulated manner by actuators 17, 18 in accordance with the amount of heat required in the heat exchangers. In the return conduits 15, the heat exchangers 115 comprising the heat transfer surfaces vaporising the flow of heat carrier material in a compacted state are guided by means of actuators 17 fitted in the lower part of the return conduits in such a way that the temperature of the gas remains at its set value after the central pipe 21 of the separator. Similarly, in the return conduits 16, the heat exchangers 116 comprising the heat transfer surfaces superheating the flow of heat carrier material in a compacted state are guided by means of actuators 18 fitted in the lower part of the superheating return conduits in such a way that the temperature of the superheated steam remains at its set value.

Uncooled return conduits 19 preferably act as overflow conduits, whereby that part of the heat carrier particles which is not intentionally guided into the return conduits 15, 16, is guided as a self-regulating flow through the uncooled return conduits 19 directly into the fluidized-bed chamber 8. Active control can also be used as regards the uncooled return conduit 19. Purified flue gases 171 are discharged from the separator 120 through the central pipe 21.

The load-bearing structures 22 of the reactor according to the invention are most preferably implemented as gas-tight water and/or steam cooled panels. The purpose of the heat insulators 23 of the reactor according to the invention is in turn to protect the load-bearing structures from wear and corrosion and to limit the heat flow conducted to them to be low with respect to the cooling requirement of the combustion chamber. The heat insulators can be implemented most preferably with conventional, for example, ceramic materials.

Although the invention is described above with reference to a single embodiment shown in FIGS. 1-4, it is obvious that the invention is not, however, limited to this description and these figures, but various modifications are conceivable within the scope of the appended claims and features disclosed in connection with different embodiments can likewise be used within the basic idea of the invention in connection with other embodiments and/or the features presented can be combined into different entities, if so desired and the technical possibilities for this exist. Any inventive embodiment can, therefore, be carried out within the inventive idea. Although this application discloses the application of the invention mainly to circulating mass reactors, it may obviously also be used in connection with a conventional fluidized-bed reactor, as well as in other steam boiler types.

The invention claimed is:

1. A method for enhancing the operation of a circulating mass reactor, in which circulating mass reactor, at least a part of the heat contained by the flue gases formed in the circulating mass reactor is transferred to the fluidized material arranged to circulate in the circulating mass reactor, and which circulating mass reactor comprises a fluidized-bed chamber, in the lower part of which is provided a fluidized bed containing fluidized material, means for separating fluidized material from the flue gases, and a return conduit system, through which the fluidized material can be returned to the fluidized-bed chamber and which includes at least one cooled return conduit, in which a part of the heat energy contained by the fluidized material passing there through is transferred to the heat transfer liquid circulating in the circulating mass reactor by means of heat exchangers fitted in the return conduits, wherein that for the combustion of fuel taking place in the circulation mass reactor is provided a lower combustion chamber, which comprises a fluidized-bed chamber, and an upper combustion chamber, and a flow conduit connecting them, that the flow conduit, the means for separating the fluidized material from the fuel gases and the return conduit system are arranged to be located between the lower combustion chamber and the upper combustion chamber, at least mainly above the lower combustion chamber and below the upper combustion chamber, that the lower combustion chamber and the upper combustion chamber are dimensioned in such a way that the combustion of the fuel can be essentially completed before the discharge of the flue gases from the combustion chamber, whereupon the average delay time of the flue gases in the upper combustion chamber is most preferably 0.3-3.0 seconds, and that the fluidized material is separated from the flue gases after the upper combustion chamber and guided back to the fluidized-bed chamber through cooled return conduits and/or an uncooled return conduit system in the desired ratio.

2. A method as claimed in claim 1, wherein calculated on the basis of the effective heat value of the fuel, the specific volume of the lower combustion chamber is most preferably 2.0-0.3 m3/MW.

3. A method as claimed in claim 1, wherein the cooling of the lower combustion chamber, the upper combustion chamber and the flow conduit connecting them takes place mainly adiabatically by means of the fluidized material circulating in them.

4. A method as claimed in claim 1, wherein the ratio of the average flow cross-section of the riser conduit to the average free surface of the vertical cross-section of the upper part of the lower combustion chamber is less than 0.5.

5. A method as claimed in claim 1, wherein the horizontal velocity component of the gas calculated on the basis of the flow cross-section of the vertical section of the combustion chamber with the nominal load of the circulating mass reactor is between 2-15 m/s.

6. A method as claimed in claim 1, wherein the fuel supply devices and the end of the riser conduit on the lower combustion chamber side are located essentially on opposite sides of the lower combustion chamber.

7. A method as claimed in claim 1, wherein as means for separating the fluidized material from the flue gases is provided a separator, which includes a separating chamber that is essentially open from its lower part.

8. A method as claimed in claim 7, wherein the flue gas flow from the upper combustion chamber and the heat carrier particles of the fluidized material are guided to the separator essentially directly downwards in such a way that a swirl is formed in the separator chamber around an essentially horizontal shaft.

9. A combustion method as claimed in claim 1, wherein in the return conduits, the fluidized material is arranged to flow in a compacted state at least at the heat exchangers.

10. A method as claimed in claim 1, wherein the ratio of the average flow cross-section of the riser conduit to the average free surface of the vertical cross-section of the upper part of the lower combustion chamber is 0.1-0.4.

11. A method as claimed in claim 1, wherein the ratio of the average flow cross-section of the riser conduit to the average free surface of the vertical cross-section of the upper part of the lower combustion chamber is 0.15-0.3.

12. A method as claimed in claim 1, wherein the horizontal velocity component of the gas calculated on the basis of the flow cross-section of the vertical section of the combustion chamber with the nominal load of the circulating mass reactor is between 4-12 m/s.

13. A method as claimed in claim 1, wherein the horizontal velocity component of the gas calculated on the basis of the flow cross-section of the vertical section of the combustion chamber with the nominal load of the circulating mass reactor is between 5-10 m/s.

14. A circulating mass reactor, in which at least a part of the heat contained by the flue gases formed in the circulating mass reactor is transferred to the fluidized material arranged to circulate in the circulating mass reactor, and which circulating mass reactor comprises a fluidized-bed chamber, in the lower part of which is provided a fluidized bed containing fluidized material, means for separating fluidized material from the flue gases, and a return conduit system, through which the fluidized material can be returned to the fluidized-bed chamber and which includes at least one cooled return conduit, in which a part of the heat energy contained by the fluidized material passing therethrough is transferred to the heat transfer liquid circulating in the circulating mass reactor by means of heat exchangers fitted in the return conduits, wherein that for the combustion of fuel taking place in the circulation mass reactor is provided a lower combustion chamber, which comprises a fluidized-bed chamber, and an upper combustion chamber, and a flow conduit connecting them, that the flow conduit, the means for separating the fluidized material from the fuel gases and the return conduit system are arranged to be located essentially between the lower combustion chamber and the upper combustion chamber, above the lower combustion chamber and below the upper combustion chamber, that the lower combustion chamber and the upper combustion chamber are dimensioned in such a way that the combustion of the fuel can be essentially completed before the discharge of the flue gases from the combustion chamber, whereupon the average delay time of the flue gases in the upper combustion chamber is most preferably 0.3-3.0 seconds, and that the fluidized material can be separated from the flue gases after the upper combustion chamber and be guided back to the fluidized-bed chamber through cooled return conduits and/or an uncooled return conduit system in the desired ratio.

15. A circulating mass reactor as claimed in claim 14, wherein calculated on the basis of the effective heat value of the fuel, the specific volume of the lower combustion chamber is most preferably 2.0-0.3 m3/MW.

16. A circulating mass reactor as claimed in claim 15, wherein the cooling of the lower combustion chamber, the upper combustion chamber and the flow conduit connecting them is arranged to take place mainly adiabatically by means of the fluidized material circulating in them.

17. A circulating mass reactor as claimed in claim 14, wherein the ratio of the average flow cross-section of the riser conduit to the average free surface of the vertical cross-section of the upper part of the lower combustion chamber is arranged to be less than 0.5.

18. A circulating mass reactor as claimed in claim 14, wherein the horizontal velocity component of the gas calculated on the basis of the flow cross-section of the vertical section of the combustion chamber with the nominal load of the circulating mass reactor is 2-15 m/s.

19. A circulating mass reactor as claimed in claim 14, wherein the fuel supply devices and the end of the riser conduit on the lower combustion chamber side are located essentially on opposite sides of the lower combustion chamber.

20. A circulating mass reactor as claimed in claim 14, wherein as means for separating fluidized material from the flue gases is provided a separator, which includes a separating chamber that is essentially open from its lower part.

21. A circulating mass reactor as claimed in claim 20, wherein the flue gas flow from the upper combustion chamber and the heat carrier particles of the fluidized material are guided to the separator essentially directly downwards in such a way that a swirl is formed in the separator chamber around an essentially horizontal shaft.

22. A circulating mass reactor as claimed in claim 14, wherein the horizontal velocity component of the flue gases calculated on the basis of the flow cross-section of the inlet of the separator with the nominal load of the circulating mass reactor is arranged to be 4-25 m/s.

23. A circulating mass reactor as claimed in claim 14, wherein in the return conduits, the fluidized material flows in a compacted state at least at the heat exchangers.

24. A circulating mass reactor as claimed in claim 14, wherein the essentially horizontal, rectangular separator inlet of the combustion gas and the heat carrier particles is fitted in the lower part of the combustion chamber.

25. A circulating mass reactor as claimed in claim 14, wherein the ratio of the free surface of the opening connecting the swirl chamber to the upper part of the return conduit system to the largest horizontal cross-section of the swirl chamber is most preferably greater than 0.7.

26. A circulating mass reactor as claimed in claim 14, wherein the essentially upwards directed secondary air nozzles in the mixing space are most preferably fitted on the bottom of the mixing space, on opposite sides of the fluidized-bed chamber.

27. A circulating mass reactor as claimed in claim 14, wherein the ratio of the average flow cross-section of the riser conduit to the average free surface of the vertical cross-section of the upper part of the lower combustion chamber is arranged to be 0.1-0.4.

28. A circulating mass reactor as claimed in claim 14, wherein the ratio of the average flow cross-section of the riser conduit to the average free surface of the vertical cross-section of the upper part of the lower combustion chamber is arranged to be 0.15-0.3.

29. A circulating mass reactor as claimed in claim 14, wherein the horizontal velocity component of the gas calculated on the basis of the flow cross-section of the vertical section of the combustion chamber with the nominal load of the circulating mass reactor is 4-12 m/s.

30. A circulating mass reactor as claimed in claim 14, wherein the horizontal velocity component of the gas calculated on the basis of the flow cross-section of the vertical section of the combustion chamber with the nominal load of the circulating mass reactor is 5-10 m/s.

31. A circulating mass reactor as claimed in claim 14, wherein the horizontal velocity component of the flue gases calculated on the basis of the flow cross-section of the inlet of the separator with the nominal load of the circulating mass reactor is arranged to be 5-20 m/s.

32. A circulating mass reactor as claimed in claim 14, wherein the horizontal velocity component of the flue gases calculated on the basis of the flow cross-section of the inlet of the separator with the nominal load of the circulating mass reactor is arranged to be 5-15 m/s.

* * * * *